US007103270B1

(12) United States Patent
Chen

(10) Patent No.: US 7,103,270 B1
(45) Date of Patent: Sep. 5, 2006

(54) STEAM CLEANER WITH MULTIPLE PROTECTIONS

(76) Inventor: Chung-Ming Chen, 2 Fl., No. 13, Lane 218, Chuan-Hsien St., Taipei (TW) 112

( * ) Notice: Subject to any disclaimer, the term of this patent is extended or adjusted under 35 U.S.C. 154(b) by 0 days.

(21) Appl. No.: 11/211,587

(22) Filed: Aug. 26, 2005

(51) Int. Cl.
*F22B 1/20* (2006.01)

(52) U.S. Cl. ..... 392/386; 392/403; 392/394

(58) Field of Classification Search ..... None
See application file for complete search history.

(56) References Cited

U.S. PATENT DOCUMENTS 4,068,340 A * 1/1978 Forward ..... 15/321
5,146,647 A * 9/1992 Blase et al. ..... 15/321
5,447,597 A * 9/1995 Zimmermann et al. ..... 156/584
5,502,872 A * 4/1996 Chae et al. ..... 15/320
5,920,955 A 7/1999 Berfield
5,966,775 A 10/1999 Berfield
6,009,596 A 1/2000 Buss et al.
6,119,304 A 9/2000 Berfield et al.
6,148,144 A * 11/2000 Milanese ..... 392/405
6,226,831 B1 5/2001 Berfield
6,347,430 B1 2/2002 Buss et al.
6,481,049 B1 11/2002 Berfield
6,647,204 B1 * 11/2003 Hutchinson ..... 392/491
6,934,995 B1 * 8/2005 Wheeler et al. ..... 15/344
2005/0050670 A1 * 3/2005 Kumazaki ..... 15/320

* cited by examiner

*Primary Examiner*—Thor S. Campbell
(74) *Attorney, Agent, or Firm*—Birch, Stewart, Kolasch & Birch, LLP

(57) ABSTRACT

A steam cleaner with multiple protections includes a machine body, in which first and second protections are provided. The first protection includes a pressure controller and a relief valve, and the second protection includes a temperature controller and a fuse unit. When a boiler provided in the machine body has an internal pressure or an internal temperature exceeded a value preset for the pressure controller or the temperature controller, respectively, a power control unit automatically power off the steam cleaner. When the boiler has an internal pressure exceeded a value preset for the relief valve, steam is immediately discharged from the boiler, and when the boiler has an internal temperature exceeded a value preset for the fuse unit, heating of the boiler is immediately stopped to avoid any danger.

11 Claims, 5 Drawing Sheets

STEAM CLEANER WITH MULTIPLE PROTECTIONS

FIELD OF THE INVENTION

The present invention relates to a steam cleaner that is able to produce steam and use the produced steam to clean things, and more particularly to a steam cleaner that has first and second protections to maintain a boiler of the steam cleaner within preset pressure and temperature values.

BACKGROUND OF THE INVENTION

People usually utilize a steam cleaner to produce steam and spray the produced steam against dirty places to achieve the purpose of cleaning and disinfecting the dirty places. A conventional steam cleaner typically includes a boiler for heating water to produce steam, which is then conveyed via a heat-resistant tube to a dusting and cleaning brush to spray against dirty places.

Water is introduced from a water tank into the boiler, at where the water is heated until steam is produced. At this point, pressure is formed in the boiler.

When the steam cleaner operates, the steam is discharged in different volume and at different time. Therefore, the pressure inside the boiler is unstable. Meanwhile, the boiler is constantly heated while water is not introduced into the boiler at fixed time or in fixed volume, resulting in an unstable temperature in the boiler.

Due to the unstable internal pressure and temperature of the boiler, the conventional steam cleaner is subject to the risk of explosion. Therefore, necessary protections in the steam cleaner are required to control the internal pressure and temperature of the boiler, so as to avoid any danger during a cleaning work using the steam cleaner.

It is therefore tried by the inventor to develop a steam cleaner with multiple protections to eliminate the drawbacks existed in the conventional steam cleaner.

SUMMARY OF THE INVENTION

A primary object of the present invention is to provide a steam cleaner that automatically powers off when a boiler thereof has an internal pressure exceeded a preset value.

Another object of the present invention is to provide a steam cleaner that automatically discharges steam when a boiler thereof has an internal pressure exceeded a preset value.

A further object of the present invention is to provide a steam cleaner that automatically powers off when a boiler thereof has an internal temperature exceeded a preset value.

A still further object of the present invention is to provide a steam cleaner that automatically stops heating when a boiler thereof has an internal temperature exceeded a preset value.

A still further object of the present invention is to provide a steam cleaner that may provide vacuum cleaning and steam cleaning functions at the same time.

To achieve the above and other objects, the steam cleaner of the present invention includes a machine body having a first and a second protection provided therein. The machine body includes a power control unit, a boiler, and a water storage unit; the first protection includes a pressure controller and a relief valve; and the second protection includes a temperature controller and a fuse unit.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
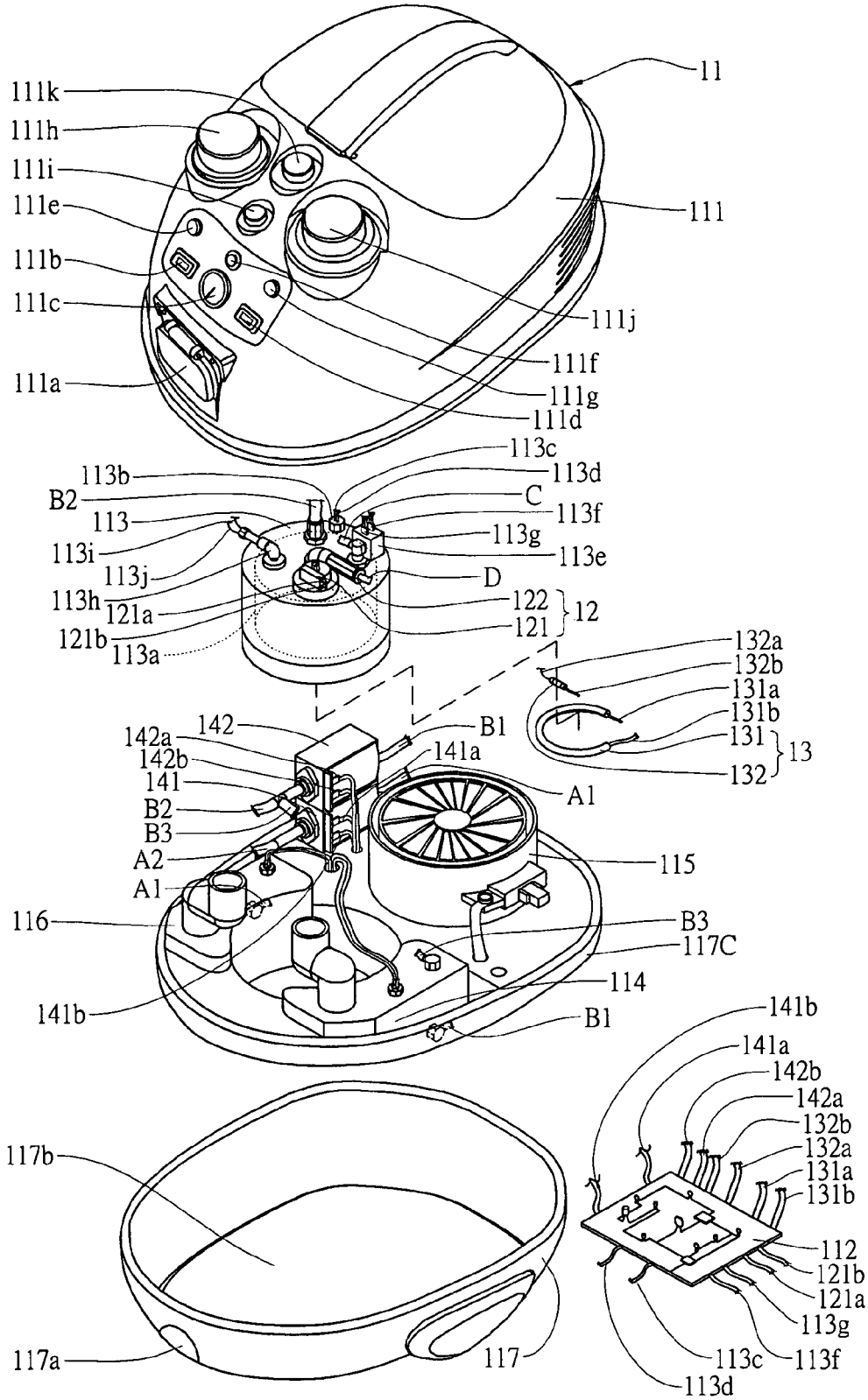
FIG. 1 is an exploded perspective view of a steam cleaner with multiple protections according to the present invention.

Please refer to FIG. 1 that is an exploded perspective view of a steam cleaner with multiple protections according to a preferred embodiment of the present invention. As shown, the steam cleaner of the present invention includes a machine body 11, a first protection 12, and a second protection 13.

The machine body 11 includes an upper case 111, a power control unit 112, which is, for example, a circuit board attached to a lower side of a plate 117*c*, a boiler 113, a water storage unit 114, a vacuum motor 115, a detergent holding unit 116, and a lower case 117.

The first protection 12 includes a pressure controller 121 and a relief valve 122. The pressure controller 121 is electrically connected at one side to the power control unit 112 via wires 121*a*, 121*b*, and at another side to the boiler 113. The relief valve 122 is connected at one side to a receiving space 117*b* defined in the lower case 117, and at another side to the boiler 113.

The second protection 13 includes a temperature controller 131 and a fuse unit 132. The temperature controller 131 is electrically connected at one side to the power control unit 112 via wires 131*a*, 131*b*, and at another side to a hottest area (i.e. a bottom) of the boiler 113. The fuse unit 132 is electrically connected at two ends to the power control unit 112 via wires 132*a*, 132*b*.

The boiler 113 is internally provided with a water tank 113*a*, in which a water level detector 113*b* is provided to detect and control the volume of water stored in the water tank 113*a*. When the level in the water tank 113*a* is lower than a height preset by the water level detector 113*b*, a signal of low level is sent to the power control unit 112 from the water level detector 113*b* via wires 113*c*, 113*d*, which are extended from two sides of the water level detector 113*b* to the power control unit 112.

A first pumping motor 141 is provided between and connected to the detergent holding unit 116 and the boiler 113, and is electrically connected to the power control unit 112 via wires 141*a*, 141*b*. A second pumping motor 142 is provided between and connected to the water storage unit 114 and the boiler 113, and is electrically connected to the power control unit 112 via wires 142*a*, 142*b*. The boiler 113 has a first steam tube C connected thereto for discharging steam. An electromagnetic valve 113*e* is provided on the first steam tube C and electrically connected to the power control unit 112 via wires 113*f*, 113*g*. And, a second steam tube D is provided between and connected to the relief valve 122 and the lower case 117.

The first pumping motor 141 is connected at an input end to the detergent holding unit 116 via a first detergent supply tube A1, and at an output end to the first steam tube C via a second detergent supply tube A2. The second pumping motor 142 is connected at an input end to the water storage unit 114 via a first water supply tube B1, and at an output end to the boiler 113 via a second water supply tube B2. The second pumping motor 142 is also connected at the output end to the water storage unit 114 via a third water supply tube B3, via which water overflowed from the second water supply tube B2 flows back into the water storage unit 114 again.

Figure 2:
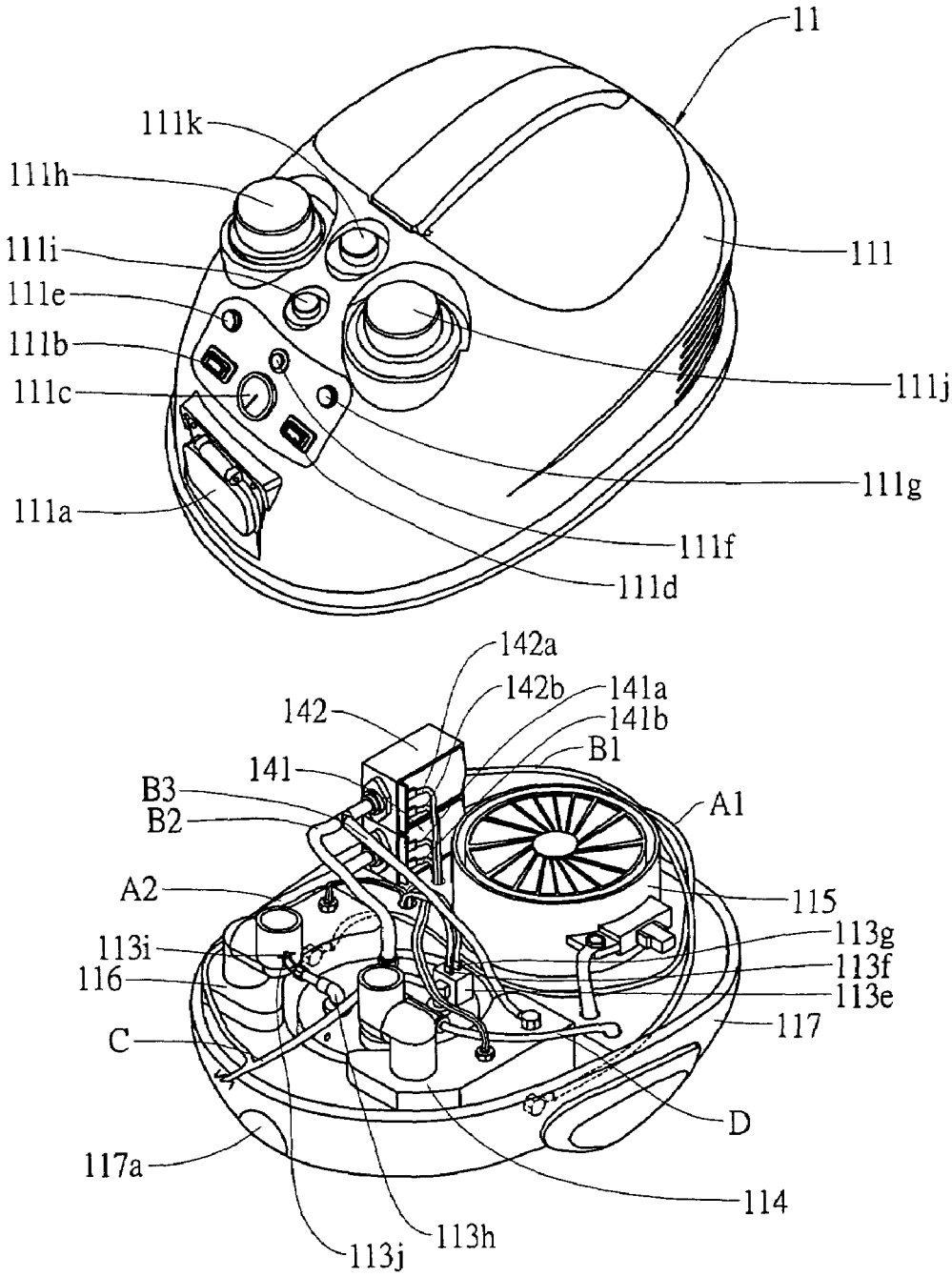
FIG. 2 is an assembled perspective view of the steam cleaner of FIG. 1 with an upper case thereof in an opened position.
Figure 3:
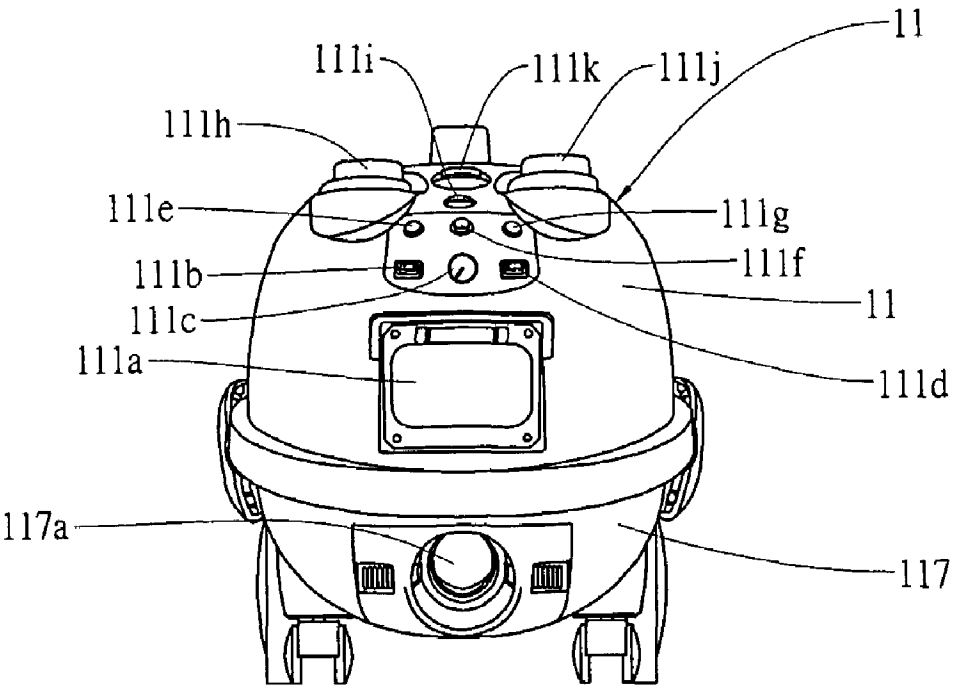
FIG. 3 is an assembled front perspective view of the steam cleaner of the present invention.
Figure 4:
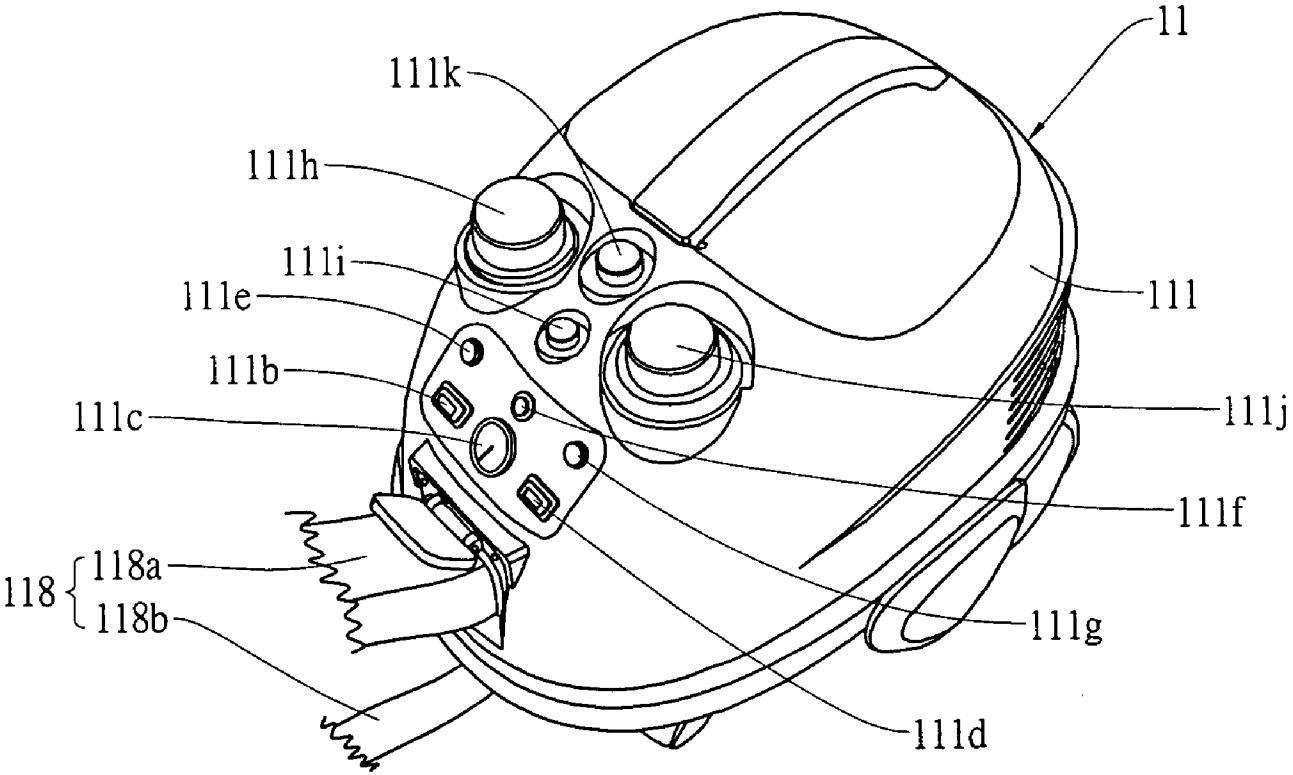
FIG. 4 is an assembled perspective view of the steam cleaner of the present invention with a steam hose and a vacuum hose connected thereto.

Please refer to FIG. 2 that is an assembled perspective view of the steam cleaner of the present invention with the upper case 111 in an opened position, and to FIG. 3 that is an assembled front perspective view of the steam cleaner of the present invention. As shown, on the upper case 111, there is provided a steam switch 111*b*, a steam pressure gauge 111*c*, a vacuum switch 111*d*, an indicator of detergent storage 111*e*, an indicator of steam 111*f*, an indicator of water storage 111*g*, a detergent inlet 111*h*, a steam control knob 111*i*, a water inlet 111*j*, and a vacuum control knob 111*k*. Wherein, the steam pressure gauge 111*c* is electrically connected to a steam pressure detecting unit 113*h* provided on the boiler 113 via wires 113*i*, 113*j*.

Figure 5:
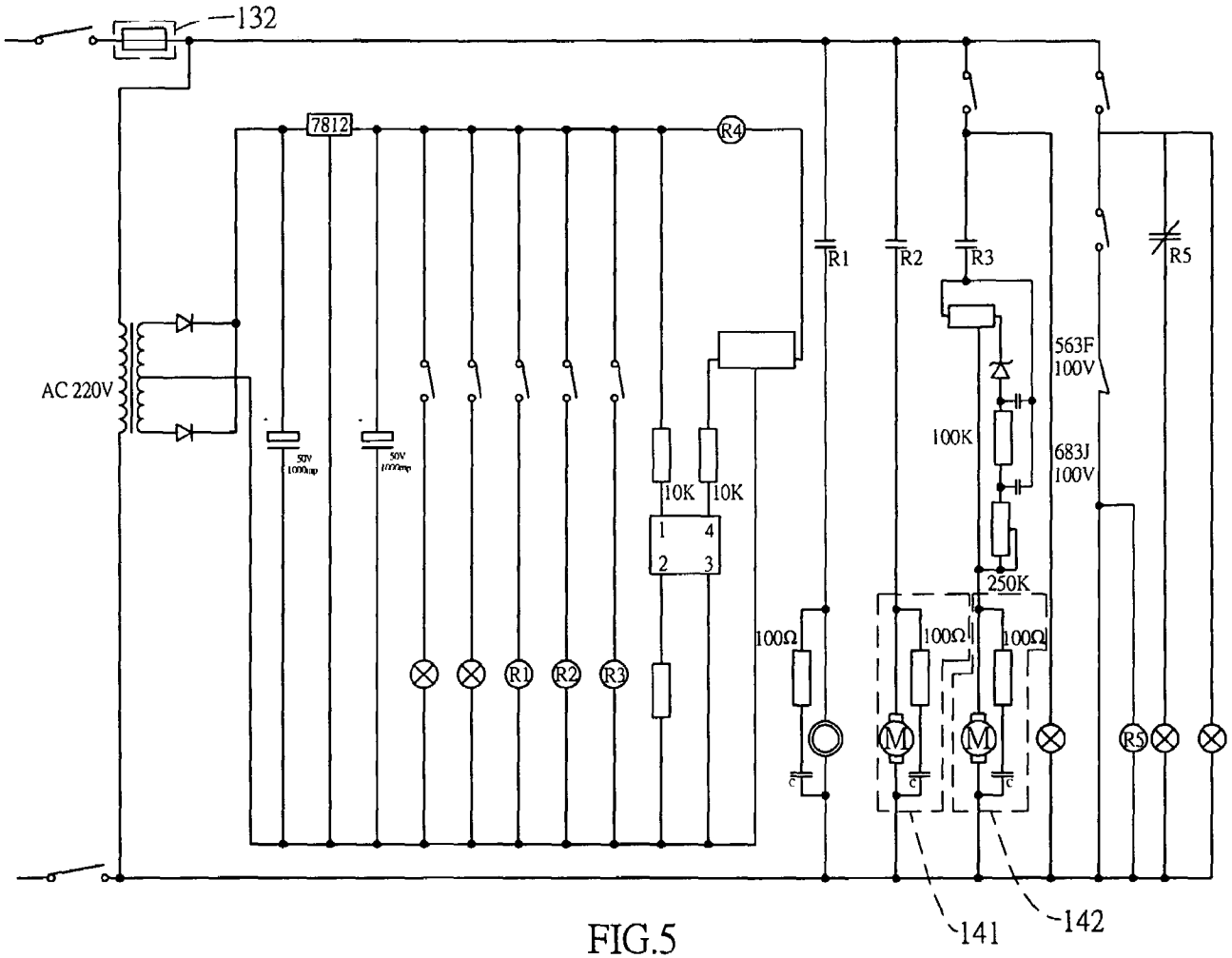
FIG. 5 is a circuit diagram of the steam cleaner of the present invention.

Please refer to FIG. 5 that is a circuit diagram of the steam cleaner of the present invention. When the boiler 113 on the machine body 11 has an internal pressure exceeded a value preset for the pressure controller 121, such as 3.2 $kg/cm^2$~3.8 $kg/cm^2$, the power control unit 112 would automatically power off the steam cleaner. And, when the boiler 113 has an internal temperature exceeded a value preset for the temperature controller 131, such as 150° C.~160° C., the power control unit 112 would power off the steam cleaner, too. When the boiler 113 has an internal pressure exceeded a value preset for the relief valve 122, such as 4.5 $kg/cm^2$, steam is automatically discharged immediately. And, when the boiler 113 has an internal temperature exceeded a value preset for the fuse unit 132, such as 170° C.~180° C., heating of the boiler 113 is immediately stopped to avoid any dangerous event.

Further, the upper case 111 is provided at a predetermined position with a through hole 111*a* for a steam hose 118*a* included in a connecting hose set 118 to extend thereinto to connect to the first steam tube C for outputting steam. Since the first steam tube C is connected to the second detergent supply tube A2, detergent may be supplied along with steam. The lower case 117 is provided at a predetermined position with a through hole 117*a* for a vacuum hose 118*b* included in the connecting hose set 118 to extend thereinto to connect to the vacuum motor 115, enabling the steam cleaner of the present invention to perform the vacuum cleaning function at the same time.

The present invention is superior to the prior art due to the following advantages and effects:

1. The pressure controller 121, the temperature controller 131, the relief valve 122, and the fuse unit 132 together form multiple protections for the steam cleaner of the present invention to function stably without the risk of causing any dangerous event.
2. The steam cleaner of the present invention provides not only the steam cleaning function, but also the vacuum cleaning function. A user need not to expend extra money to purchase two units of cleaning machines separately for steaming cleaning and vacuum cleaning. The steam cleaner of the present invention provides quick and convenient cleaning and can be easily stored when it is not in use.
3. With the water level detector 113*b* provided in the boiler 113 of the steam cleaner of the present invention, a signal of low water storage in the water tank 113*a* of the boiler 113 is automatically sent to the power control unit 112 via the wires 113*c*, 113*d*, so that the power control unit 112 may timely send a signal to the second pumping motor 142 via the wires 142*a*, 142*b*, enabling the second pumping motor 142 to supply water stored in the water storage unit 114 to the water tank 113*a* of the boiler 113 via the first and the second water supply tube B1, B2. However, the second pumping motor 142 automatically stops pumping when the water level in the water tank 113*a* is normal, so that water could be supplied to the water storage unit 114 at any time during the cleaning work without the risk of steam explosion.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A steam cleaner with multiple protections, comprising a machine body, pressure protection, and temperature protection;

said machine body including a power control unit, a boiler, and a water storage unit;

said pressure protection including a pressure controller, and a relief valve separate from said pressure controller;

said temperature protection including a temperature controller, and a fuse unit separate from said temperature controller;

said pressure controller being connected at one side to said power control unit, and at another side to said boiler;

said relief valve being connected at one side to a receiving space defined in a lower case of said machine body, and at another side to said boiler;

said temperature controller being connected at one side to said power control unit, and at another side to said boiler;

said fuse unit being provided on said boiler and electrically connected to said power control unit via wires; and said water storage unit being connected to said boiler.

2. The steam cleaner with multiple protections as claimed in claim 1, wherein said machine body is internally provided with a vacuum motor, to which a vacuum hose included in a connecting hose set is connected.

3. The steam cleaner with multiple protections as claimed in claim 1, wherein said machine body is internally provided with a detergent holding unit.

4. The steam cleaner with multiple protections as claimed in claim 3, further comprising a first pumping motor provided between and connected to said detergent holding unit and said boiler.

5. The steam cleaner with multiple protections as claimed in claim 1, further comprising a second pumping motor provided between and connected to said water storage unit and said boiler.

6. The steam cleaner with multiple protections as claimed in claim 5, wherein said second pumping motor is connected at an output end to said water storage unit via a third water supply tube.

7. The steam cleaner with multiple protections as claimed in claim 1, wherein said boiler is internally provided with a water tank.

8. The steam cleaner with multiple protections as claimed in claim 7, wherein said water tank is connected to a second pumping motor via a second water supply tube, and said second pumping motor being connected to said water storage unit via a first water supply tube.

9. The steam cleaner with multiple protections as claimed in claim 8, wherein said water tank is internally provided with a water level detector.

10. The steam cleaner with multiple protections as claimed in claim 1, wherein said pressure controller and said relief valve are actuated at different pressures.

11. The steam cleaner with multiple protections as claimed in claim 1, wherein said temperature controller and fuse unit are actuated at different temperatures.

* * * * *